US010799803B2

(12) United States Patent
Hu et al.

(10) Patent No.: US 10,799,803 B2
(45) Date of Patent: Oct. 13, 2020

(54) MULTI-DIMENSIONAL THEATRE BASED ON MECHANICAL ARM TYPE ROLLER COASTER

(71) Applicant: DALIAN WANDA GROUP CO., LTD., Dalian (CN)

(72) Inventors: Zhanghong Hu, Beijing (CN); Yuan Wang, Beijing (CN); Yong Mei, Beijing (CN); Hengsheng Fu, Beijing (CN); Miao Wang, Beijing (CN); Chuzhu Feng, Beijing (CN)

(73) Assignee: DALIAN WANDA GROUP CO., LTD., Dalian (CN)

( * ) Notice: Subject to any disclaimer, the term of this patent is extended or adjusted under 35 U.S.C. 154(b) by 420 days.

(21) Appl. No.: 15/570,920

(22) PCT Filed: Jul. 8, 2015

(86) PCT No.: PCT/CN2015/083519
§ 371 (c)(1),
(2) Date: Oct. 31, 2017

(87) PCT Pub. No.: WO2016/176908
PCT Pub. Date: Nov. 10, 2016

(65) Prior Publication Data

US 2018/0290062 A1 Oct. 11, 2018

(30) Foreign Application Priority Data

May 7, 2015 (CN) ..... 2015 2 0289214 U

(51) Int. Cl.
*A63G 21/04* (2006.01)
*A63G 31/16* (2006.01)
*A63G 7/00* (2006.01)

(52) U.S. Cl.
CPC ..... *A63G 21/04* (2013.01); *A63G 7/00* (2013.01); *A63G 31/16* (2013.01)

(58) Field of Classification Search
CPC ..... A63G 21/04; A63G 21/20; A63G 21/14
See application file for complete search history.

(56) References Cited

U.S. PATENT DOCUMENTS 8,257,133 B2 * 9/2012 Ando ..... A63H 18/02 348/61
2002/0065160 A1 5/2002 Christmas
(Continued)

FOREIGN PATENT DOCUMENTS

CN 203425502 U * 2/2014 ..... A63G 21/04
CN 203425502 U 2/2014
(Continued)

OTHER PUBLICATIONS

Supplementary EP Search Report dated Nov. 21, 2018 issued by the European Patent Office in corresponding Application No. EP15891159, 8 pages.
(Continued)

*Primary Examiner* — Scott A Browne
(74) *Attorney, Agent, or Firm* — Dilworth IP, LLC

(57) ABSTRACT

A multi-dimensional theatre based on a mechanical arm type roller coaster comprises a track, a track traffic control system, static scenes and dynamic scenes arranged based on a travelling path of the track and various special effect devices coordinated with a plot, and a plurality of mechanical arm type riding devices travelling on the track. The top of both wings of the track is combined with a wheel train of the riding devices, wherein the travel of the riding devices is controlled by the track traffic control system. Multiple groups of friction wheels driven by respective electric motors are mounted in parallel on the main body of the track. The electric motors are fixedly mounted within the main
(Continued)

body via multiple groups of corresponding adjustable brackets. The riding devices comprises a roller coaster chassis and a mechanical arm, wherein a seat is mounted at an end of the arm.

7 Claims, 3 Drawing Sheets

(56) References Cited

U.S. PATENT DOCUMENTS

| | | | | |
|---|---|---|---|---|
| 2003/0172834 | A1 | 9/2003 | De-Gol | |
| 2007/0089630 | A1* | 4/2007 | Gordon | A63G 7/00 104/53 |
| 2007/0106484 | A1* | 5/2007 | Sweatman | A63G 7/00 702/188 |
| 2013/0017893 | A1 | 1/2013 | Feuer et al. | |
| 2013/0233198 | A1 | 9/2013 | Roodenburg et al. | |
| 2014/0309822 | A1 | 10/2014 | Beutler | |
| 2018/0072328 | A1* | 3/2018 | Roodenburg | B61B 13/127 |

FOREIGN PATENT DOCUMENTS

| | | | |
|---|---|---|---|
| CN | 203977909 | U | 12/2014 |
| DE | 1478271 | A1 | 3/1969 |
| GB | 2291307 | A | 1/1996 |
| JP | H0386187 | A | 4/1991 |

OTHER PUBLICATIONS

PCT International Search Report and Written Opinion dated Feb. 14, 2016 from corresponding Application No. PCT/CN2015/083519, 9 pages.

* cited by examiner

MULTI-DIMENSIONAL THEATRE BASED ON MECHANICAL ARM TYPE ROLLER COASTER

TECHNICAL FIELD

The present utility model relates to an amusement facility, and more particularly, to a multi-dimensional theatre based on a mechanical arm type roller coaster.

BACKGROUND

Nowadays, black ride amusement projects usually adopt ground wheeled vehicles as riding devices, several riding devices travel on a horizontal track in a centralized control mode, and tourists can experience static and dynamic image scenes and interact with the image scenes during the operation of the system. Such solution may meet the experience demands of tourists to some extent, but still has the following defects: 1) tourists are in a cabin of a vehicle body and their motions are limited by the vehicle body. Even if a motion platform is mounted on a roller coaster chassis, the magnitude and degree of freedom of the tourists' motion are still limited, and some actions, such as flying, etc. cannot be simulated, and immersive feelings are not enough; 2) the riding devices travel on a horizontal track, and the instant overload is small, the tourists may even predict the position of the riding devices at the next moment, which hardly meets tourists' requirements for diversity of experiences.

SUMMARY

The purpose of the present utility model is to break through inherent modes of traditional black ride projects, make improvements mainly in the aspects of track and riding devices, and provide a multi-dimensional theatre based on a mechanical arm type roller coaster so as to enlarge range of motion and degrees of freedom for tourists.

The multi-dimensional theatre based on a mechanical arm type roller coaster according to the present utility model comprises a track, a track traffic control system, static scenes and dynamic scenes arranged based on a travelling path of the track and various special effect devices coordinated with a plot, and a plurality of mechanical arm type riding devices travelling on the track. The tops of both wings of the track are combined with a wheel train of the mechanical arm type riding devices, the travel of the mechanical arm type riding devices along the track is controlled by the track traffic control system, multiple groups of friction wheels driven by respective electric motors are mounted in parallel on the main body of the track inside both wings, the electric motors driving the friction wheels are fixedly mounted within the main body between both wings of the track via multiple groups of corresponding adjustable brackets. The mechanical arm type riding devices are composed of a roller coaster chassis and a mechanical arm, a seat is mounted at an end of the mechanical arm, the wheel train of the mechanical arm type riding device is mounted on the lower surface of the roller coaster chassis, and a pre-load contact can be formed between the friction wheels and fin plates at the lower part of the roller coaster chassis.

The roller coaster chassis comprises a chassis support, and a power distribution device, a communication system, a positioning device, an anti-collision apparatus and a power taking device mounted on the chassis support.

The power taking device on the roller coaster chassis takes power from the track via a sliding wire.

The positioning device adopts a radio frequency identification technology or a magnetic positioning technology.

The anti-collision apparatus is a buffer bar capable of stretching out automatically.

A chain stop apparatus is mounted on the main body of the track, the chain stop apparatus comprises a transmission chain in synchronous motion with the friction wheel, a unidirectional rotating ratchet wheel apparatus engaged with the transmission chain, a stop block fixed on the transmission chain, and the stop block mates with a chassis block on the lower part of the chassis support of the roller coaster chassis.

The track comprises a plurality of consecutive raising sections, down-sliding sections and spiral sections.

The track and the roller coaster chassis are installed with RFID read-write apparatus, respectively.

The mechanical arm of the multi-dimensional theatre based on a mechanical arm type roller coaster according to the present utility model can extend and make large-amplitude movements when traveling in a gentle low speed sections. During the raising or down-sliding sections, the mechanical arm will fold to lower the center of gravity of the riding devices, so as to decrease the inertial load during the acceleration/deceleration process.

The present utility model adopts a winding, undulating or intersecting track to achieve a more stimulating entertainment experience. Moreover, a large-amplitude and almost limitless motion can be achieved by improving the roller coaster chassis, adding a mechanical arm with a function of multiple degrees of freedom of motion on the roller coaster chassis, and mounting a seat for tourists at an end of the mechanical arm, so that tourists may feel high speed riding, weightlessness, flying, etc., and thereby significantly improving the experience effects.

DETAILED DESCRIPTION OF EMBODIMENTS

Figure 1:
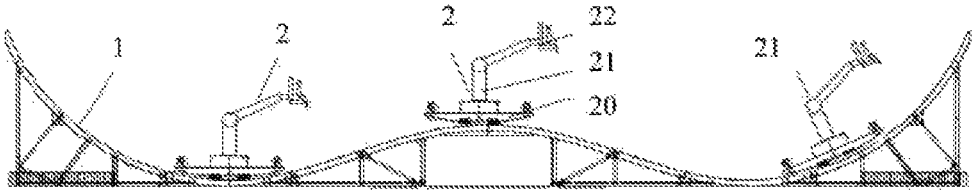
FIG. 1 is a configuration schematic view of a multi-dimensional theatre based on a mechanical arm type roller coaster according to the present utility model.

In order to further explain the principle and structure of the present utility model, preferred embodiments of the present utility model will be described in details by referring to the drawings. However, these embodiments are provided only for description or explanation purpose, rather than limiting the patent protection scope of the present utility model.

As shown in FIG. 1, a multi-dimensional theatre based on a mechanical arm type roller coaster according to the present utility model comprises a track 1, a track traffic control system, a static scene and a dynamic scene arranged based on the travelling path of the track 1 and various special effect devices coordinated with a plot (not shown in the figure), and a plurality of mechanical arm type riding devices 2 travelling on the track 1.

Figure 2:
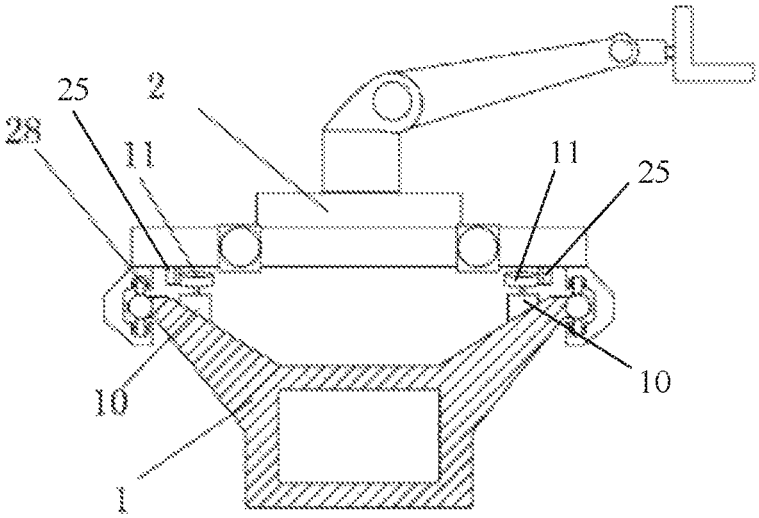
FIG. 2 is an installation structure schematic view of a track and a riding device according to the present utility model.
Figure 3:
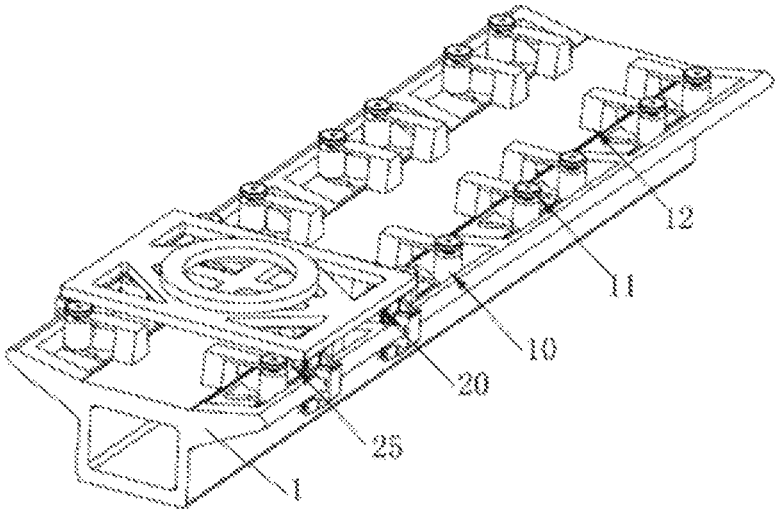
FIG. 3 is a structural schematic view of a riding device in a raising section of a track according to the present utility model.

The track 1 is divided in to raising sections, down-sliding sections and horizontal sections according to differences between specific scenes. As shown in FIG. 2, the track 1 adopts a box girder structure with a large cross section. The tops of both wings of the track 1 are combined with a wheel train 28 of the mechanical arm type riding device 2, and the travel of the mechanical arm type riding device 2 along the track 1 is controlled by the track traffic control system. The main body of the track 1 is consistent with that of the conventional roller coaster track, and will not be described in details. The differences lie in that multiple groups of friction wheels 11 driven by respective electric motors 10 are mounted in parallel on insides of both wings of the track 1. As shown in FIG. 3, the electric motors 10 driving the friction wheels 11 are fixedly mounted within the main body between both wings of the track 1 via multiple groups of corresponding adjustable brackets 12.

Figure 5:
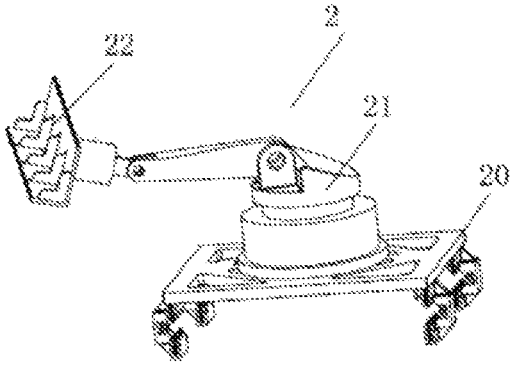
FIG. 5 is a structural schematic view of a riding device according to the present utility model.
Figure 6:
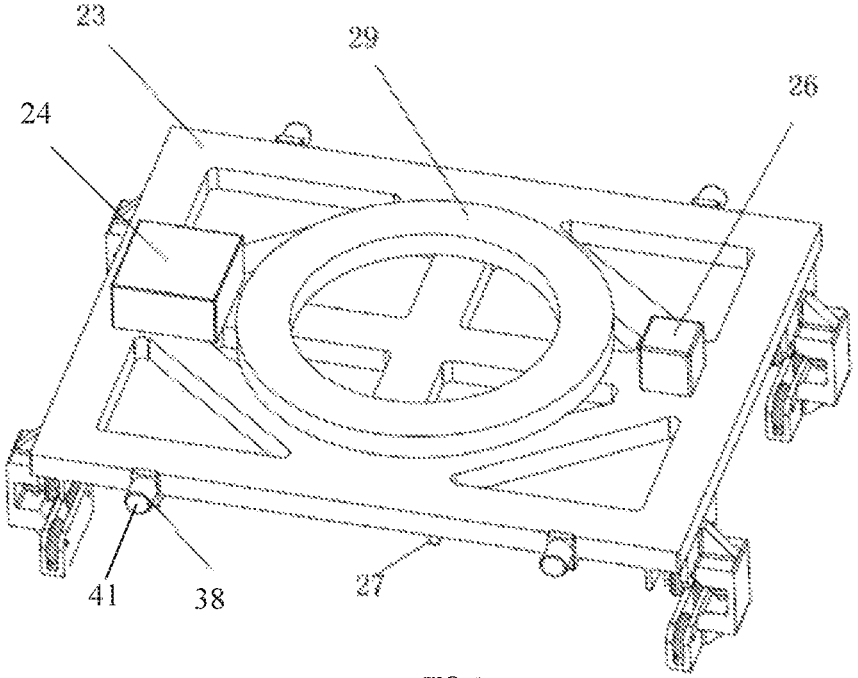
FIG. 6 is a structural schematic view of a chassis of a riding device according to the present utility model.

As shown in FIG. 5, the mechanical arm type riding device 2 is composed of a roller coaster chassis 20 and a mechanical arm 21, and a seat 22 is mounted at an end of the mechanical arm 21. As shown in FIG. 6, the roller coaster chassis 20 comprises a chassis support 23, and a power distribution device 24, a communication system 26, a positioning device 27, an anti-collision apparatus 38 and a power taking device (not shown in the figure) mounted on the chassis support 23. The chassis support 23 is a stainless steel frame with a bearing capacity larger than conventional roller coasters, which can bear the inertial load generated during the motion of the mechanical arm 21 and the tourists. The power taking device on the roller coaster chassis 23 takes power from the track 1 via a sliding wire, and the power distribution device 24 supplies power for the mechanical arm 21, the communication system 26, the positioning device 27, etc. on the mechanical arm type riding device 2. The communication system 26 is used for communicating between the mechanical arm type riding devices 2 and the track traffic control system, and between each mechanical arm type riding device 2. The positioning device 27 adopts a radio frequency identification technology or a magnetic positioning technology, which is capable of determining the position of each mechanical arm type riding device 2 on the track 1. Based on the positioning information of the mechanical arm type riding devices 2, the track traffic control system can control the travel of each mechanical arm type riding device 2, so as to ensure the active safety of the mechanical arm type riding devices 2. Meanwhile, the roller coaster chassis 23 is installed with an anti-collision apparatus 38, from which a buffer bar 41 will stretch out automatically if the distance between the mechanical arm type riding devices 2 is smaller than the safe distance. This not only can ensure the safe distance between the mechanical arm type riding devices 2, but also can absorb impact energy. The roller coaster chassis 20 of a plurality of mechanical arm type riding devices 2 can be connected to each other and travel as a train, so as to improve tourist receipts.

The mechanical arm 21 has a plurality of degrees of freedom, namely, it is composed of a plurality of rotating mechanisms, swing mechanisms and the like, to ensure that the tourists in the seat 22 at the end of the mechanical arm have the ability of six degrees of freedom motion in the air. The mechanical arm 21 can bear both the static load of the weight of itself and the tourists, as well as the inertial load generated in acceleration/deceleration processes of the mechanical arm type riding device 2. A motion control system of the mechanical arm 21 can ensure that the mechanical arm type riding device 2 achieves certain positioning and speed control precision during its dynamic travel process. When a plurality of mechanical arm type riding devices 2 are interconnected with each other, the motions of these mechanical arm type riding devices 2 should avoid interferences with each other. The movement of the mechanical arm 21 is preset by the control system to coordinate with a plot. Since these belong to conventional mechanisms or structures, they will not be described in details.

Figure 4:
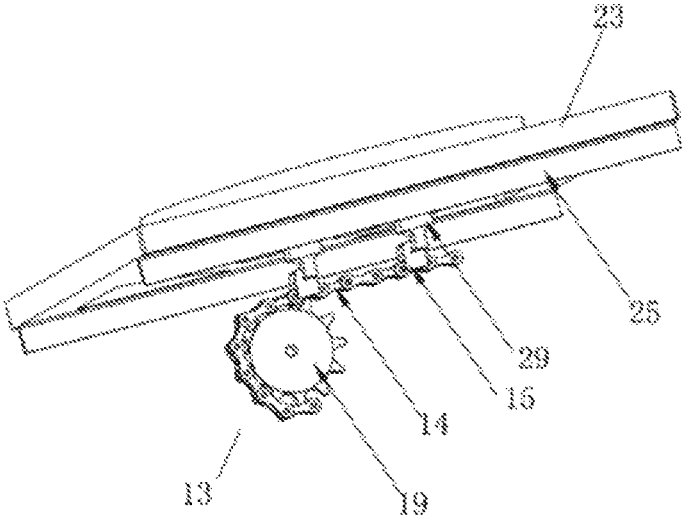
FIG. 4 is a structural schematic view of a chain stop apparatus according to the present utility model.

As shown in FIG. 4 and FIG. 6, fin plates 25 are fixedly mounted on inside of and in parallel to respective wheel trains 28 in both sides on the lower part of the chassis support 23. A pre-load contact can be formed between the fin plate 25 and the friction wheels 11 mounted on the main body of the track 1, i.e. when the mechanical arm type riding device 2 is traveling on a raising section of the track 1, multiple groups of friction wheels 11 rotate in the same direction, and thus drive the mechanical arm type riding device 2 ascending along the track 1. To ensure safety during the ascending process of the mechanical arm type riding device 2, a chain stop apparatus 13 is mounted on the track 1, as shown in FIG. 4. The chain stop apparatus 13 comprises a ratchet wheel apparatus 19 mounted on the main body of the track 1 and a transmission chain 14 unidirectional rotating with the ratchet wheel apparatus 19. The transmission chain 14, driven by the ratchet wheel apparatus 19, is in synchronous motion with the friction wheel 11. A stop block 15 is fixed on the transmission chain 14, and the stop block 15 mates with a chassis block 29 on the lower part of the chassis support 23 of the roller coaster chassis 20, and ascends as the mechanical arm type riding device 2 ascends. If the mechanical arm type riding device 2 slides downwards due to a fault, then the unidirectional motion characteristic of the stop block 15 on the transmission chain 14 of the chain stop apparatus 13 can prevent the down-slide of the mechanical arm type riding device 2. When the mechanical arm type riding device 2 enters a down-slide section, the friction wheels 11 mounted on both sides of the track 1 rotate in a direction opposite to the moving direction of the mechanical arm type riding device 2, so as to achieve deceleration braking in the down-slide section. When the mechanical arm type riding device 2 slides along a horizontal section, the friction wheels 11 mounted on the track 1 can drive or brake the mechanical arm type riding device 2. In order to improve the mechanical property of the track 1 and the mechanical arm type riding device 2, the track 1 is moderately tilted at turning points, and the tilting angle is no more than 10°.

A purpose of the track traffic control system of the present utility model is to ensure the operation security and efficiency of the system. By collecting and monitoring information of the position, speed, acceleration and operation security of the mechanical arm type riding device 2, the operation state of the mechanical arm type riding device is adjusted according to actual situations and upper level dispatching is conducted to solve the potential risks and conflicts. The mechanical arm type riding device 2 communicates with the track traffic control system and central control system via wireless or wire communications. Meanwhile, static packaging scenes and screens for playing dynamic images are disposed around the track 1 according to the plots, and the dynamic images and static scenes are seamless joined. For example, special environmental effects such as wind, water, fog, etc., together with special physical effect device capable of interaction, are disposed according to demands of the plots.

Furthermore, the track of the present utility model comprises more than one raising sections, down-sliding sections and spiral sections, so as to provide the tourists with feelings of overweight or weightless, and interactions with surrounding scenes when the mechanical arm type riding devices 2 are sliding slowly or stop. In addition, according to different demands, an encoder can be installed within the roller coaster chassis for dead-reckoning. Meanwhile, the track and the roller coaster chassis are respectively installed with RFID read-write apparatus to obtain the precise positions of the mechanical arm type riding devices.

In view of above, the multi-dimensional theatre based on a mechanical arm type roller coaster according to the present utility model can significantly enlarge the range of motion and degrees of freedom of tourists, expend the experience space, and improve the adaptability for different plots by making improvements in both aspects of the track and the mechanical arm type riding devices 2, wherein a roller coaster chassis is adopted for the riding devices, a manned mechanical arm is mounted on the roller coaster chassis and a seat for tourists is mounted at an end of the mechanical arm. Meanwhile, the tourists can experience multiple feelings such as overweight, weightless, fly, etc. in the theatre, which cannot be provided by other ground equipment, so as to greatly enrich the amusement and stimulation of the project.

We claim:

1. A multi-dimensional theatre based on a mechanical arm type roller coaster, comprising: a track, a track traffic control system, a static scene and a dynamic scene arranged based on a travelling path of the track and various special effect devices coordinated with a plot, and a plurality of mechanical arm type riding devices travelling on the track, wherein the track comprises two wings, wherein tops of both wings of the track are combined with a wheel train of the mechanical arm type riding devices, a travel of the mechanical arm type riding devices along the track is controlled by the track traffic control system, multiple groups of friction wheels driven by respective electric motors are mounted in parallel on a main body of the track inside both wings, the electric motors driving the friction wheels are fixedly mounted within the main body between both wings of the track via multiple groups of corresponding adjustable brackets, the mechanical arm type riding devices comprise a roller coaster chassis and a mechanical arm, wherein a seat is mounted at an end of the mechanical arm, the wheel train of the mechanical arm type riding devices is mounted on a lower surface of the roller coaster chassis, and a pre-load contact can be formed between the friction wheels and a fin plate at a lower part of the roller coaster chassis, wherein a chain stop apparatus is mounted on the main body of the track, the chain stop apparatus comprises a transmission chain in synchronous motion with the friction wheels, a unidirectional rotating ratchet wheel apparatus engaged with the transmission chain and a stop block fixed on the transmission chain, and the stop block mates with a chassis block on the lower part of the chassis support of the roller coaster chassis.

2. The multi-dimensional theatre based on a mechanical arm type roller coaster of claim 1, wherein the roller coaster chassis comprises a chassis support, and a power distribution device, a communication system, a positioning device, an anti-collision apparatus and a power taking device mounted on the chassis support.

3. The multi-dimensional theatre based on a mechanical arm type roller coaster of claim 2, wherein the power taking device on the roller coaster chassis takes power from the track via a sliding wire.

4. The multi-dimensional theatre based on a mechanical arm type roller coaster of claim 2, wherein the positioning device adopts a radio frequency identification technology or a magnetic positioning technology.

5. The multi-dimensional theatre based on a mechanical arm type roller coaster of claim 2, wherein the anti-collision apparatus comprises a buffer bar which is capable of stretching out automatically from the anti-collision apparatus when a distance between the mechanical arm type riding devices is smaller than a safe distance.

6. The multi-dimensional theatre based on a mechanical arm type roller coaster of claim 1, wherein the track comprises a plurality of consecutive raising sections, down-sliding sections and spiral sections.

7. The multi-dimensional theatre based on a mechanical arm type roller coaster of claim 1, wherein the track and the roller coaster chassis are installed with RFID read-write apparatus, respectively.

* * * * *